US005890713A

United States Patent [19]

Hofmann et al.

[11] Patent Number: 5,890,713

[45] Date of Patent: Apr. 6, 1999

[54] DEVICE FOR FORMING A SHEET PILE IN A DELIVERY OF A SHEET-FED PRINTING PRESS

[75] Inventors: Wolfram Hofmann, Hesseneck; Rainer Klenk, St. Leon-Rot; Michael Szeidl, Bammental, all of Germany

[73] Assignee: Heidelberger Druckmashinen AG, Heidelberg, Germany

[21] Appl. No.: 764,711

[22] Filed: Dec. 2, 1996

[30] Foreign Application Priority Data

Nov. 30, 1995 [DE] Germany ..... 195 44 706.9
Jul. 8, 1996 [DE] Germany ..... 196 27 241.6

[51] Int. Cl.[6] ..... B65H 31/36

[52] U.S. Cl. ..... 271/221; 271/223; 271/224

[58] Field of Search ..... 271/146, 221, 271/222, 223, 224

[56] References Cited

U.S. PATENT DOCUMENTS

| | | | |
|---|---|---|---|
| 1,935,767 | 11/1933 | Delany | 271/222 |
| 2,626,147 | 1/1953 | Gjostein | 271/222 |
| 3,062,539 | 11/1962 | Obenshain . | |
| 3,982,751 | 9/1976 | Obenshain . | |
| 4,318,541 | 3/1982 | Nagel et al. . | |
| 4,319,744 | 3/1982 | Nagel et al. . | |
| 5,368,288 | 11/1994 | Philipp et al. . | |
| 5,423,656 | 6/1995 | Filsinger et al. | 271/221 |
| 5,516,092 | 5/1996 | Pollich | 271/221 |

FOREIGN PATENT DOCUMENTS

| | | | |
|---|---|---|---|
| 20 32 067 | 1/1971 | Germany . | |
| 2942855 | 5/1981 | Germany | 271/146 |
| 0016937 | 1/1987 | Japan | 271/221 |

OTHER PUBLICATIONS

Patent Abstract of Japan No. 60–236936 (Yutaka), dated Nov. 25, 1985.

*Primary Examiner*—H. Grant Skaggs
*Attorney, Agent, or Firm*—Herbert L. Lerner; Laurence A. Greenberg

[57] ABSTRACT

A device for forming a sheet pile in a delivery of a sheet-fed printing press includes jogging plates for jogging edges of the sheet. The jogging plates are disposed perpendicularly to a lateral surface of the sheet pile and are drivable so as to move in a stationary sheet guide and to a sheet stop, respectively. The jogging plates are elastically suspended, without any other guide elements, in at least one of the stationary sheet guides and the sheet stop. An oscillation exciter is connected to each of the jogging plates for respectively oscillating and vibrating the jogging plates independently of a cycle of the delivery.

10 Claims, 6 Drawing Sheets

7
20
25
19
18
6
19
20
7
5

DEVICE FOR FORMING A SHEET PILE IN A DELIVERY OF A SHEET-FED PRINTING PRESS

BACKGROUND OF THE INVENTION

FIELD OF THE INVENTION

The invention relates to a device for forming a sheet pile in a delivery of a sheet-fed printing press, the device having jogging plates for jogging edges of the sheet, the jogging plates being disposed perpendicularly to a lateral surface of the sheet pile and driven so as to be movable in a stationary sheet guide and to a sheet stop, respectively, the sheet stop being adjustable, if necessary or desirable.

Devices of this general type have become known heretofore. The published German Patent Document DE 29 42 855 C2, for example, describes a device wherein jogging plates are disposed at vertical sheet-pile sides of a delivery and are attached to an electromagnetic oscillating drive. The jogging plates thus execute oscillating movements in an approximately horizontal direction, thereby thrusting against the sheet edges. With this heretofore known device, the oscillation frequency is preferably of 10 Hz, i.e., far below the mains or line frequency and only slightly above the sheet-depositing frequency of high-speed sheet-fed offset printing presses which are presently capable of delivering three to five sheets per second. Moreover, the jogging plates, with respect to the jogging movement thereof, remain mechanically guided, which results in wear and tear and in a reduction of the service life of the jogging device.

It is also been known heretofore to use mechanical drives such as crank drives, cam-type drives, and the like as drives for jogging plates, such as is described, for example, in the published German Patent Document DE 42 21 660 A1 and the German Patent DE 30 01 356. Furthermore, German Patents DE 27 51 525 and DE 30 01 354 disclose pneumatic mechanical jogging drives. None of these drives, as well, is free of wear and tear, and consequently has to be maintained, i.e., serviced, or replaced after a given period of operation.

Moreover, most of the prior-art jogging devices are operated in accordance with the cycle of the sheet delivery and an integral multiple of the delivery frequency, respectively.

With increasing machine speeds, this conventional type of drive causes problems such as an excessive development of noise, in addition to the aforementioned wear and tear. Furthermore, with these heretofore known devices, the quality of the sheet piles which are delivered is not always satisfactory.

SUMMARY OF THE INVENTION

It is accordingly an object of the invention to provide a versatile device for forming a sheet pile in a delivery of a sheet-fed rotary printing press and, more particularly, for jogging the edges of sheets forming the sheet pile, which has been improved especially with respect to high machine speeds.

With the foregoing and other objects in view, there is provided, in accordance with the invention, a device for forming a sheet pile in a delivery of a sheet-fed printing press, the device comprising jogging plates for jogging edges of the sheet, the jogging plates being disposed perpendicularly to a lateral surface of the sheet pile and being drivable so as to move in a stationary sheet guide and to a sheet stop, respectively, the jogging plates being elastically suspended, without any other guide elements, in the stationary sheet guide or the sheet stop, and an oscillation exciter connected to each of the jogging plates for respectively oscillating and vibrating the jogging plates independently of a cycle of the delivery.

In accordance with another feature of the invention, the sheet s top is adjustable.

In accordance with a further feature of the invention, the oscillation exciters are connected to the jogging plates so that almost only oscillation energy is transferable.

In accordance with an added feature of the invention, the jogging plates are connected magnetically to the oscillation exciters in a contactless manner for transferring the oscillation energy.

In accordance with an additional feature of the invention, the oscillation exciter is operative at a frequency which is proximal to the resonant frequency of the elastically suspended jogging plates.

In accordance with yet another feature of the invention, the frequency of the oscillation exciter is greater than 20 Hz.

In accordance with yet a further feature of the invention, the frequency of the oscillation exciter is within the range of 50 to 100 Hz.

In accordance with yet an added feature of the invention, a respective jogging plate is disposed in a cutout formed in the sheet guide and has an active surface incorporated into and almost flush with the surface of the sheet guide.

In accordance with yet an additional feature of the invention, the oscillation exciter has a solenoid magnet activatable against spring action, the solenoid magnet being periodically excitable.

In accordance with another feature of the invention, the oscillation exciter is an oscillation magnet elastically fastened to the respective jogging plate.

In accordance with a further feature of the invention, the oscillation exciter is an electromagnet connected to the sheet guide or a mounting support therefor, and a part made of iron or a permanent magnet is located at a respective jogging plate, the electromagnet having a field acting upon the iron part or the permanent magnet.

In accordance with a concomitant feature of the invention, the oscillation exciter is a pneumatic vibrator.

When compared with corresponding devices in the state of the art, is an essential and inventive difference is apparent in that the jogging plate may be adjustable to the sheet size or format, if necessary or desirable, that the jogging plate, after having been adjusted, is elastically suspended in a sheet guide fixed to the printing press, and that, accordingly, the jogging plate is freely swingable at the frequency predetermined by the oscillation exciter. By dispensing with a rigid mechanical connection between the jogging plate and the drive, only the oscillation energy is transferred from the oscillating drive to the jogging plate and from the jogging plate to the sheet edge, so that even with high press speeds damage to the sheets is largely excluded. The jogging plate itself is elastically suspended, for example, on springs or by rubber pads in a sheet guide and, for example, in an adjustable sheet stop. According to a preferred embodiment, the jogging plate is disposed in a cutout formed in the sheet guide, and has an active or effective surface which is incorporated or integrated into the sheet guide so as to be approximately flush with the surface of the sheet guide. In this manner, the sheet alignment is performed mainly by the sheet guide, and the oscillation energy transferred by the respective jogging plate to the respective sheet edge effects a fine adjustment of the sheet edges in order to achieve an even or smooth lateral surface of the sheet pile. The jogging plate is connected to the oscillation exciter preferably in a contactless manner, for example, magnetically, in order to transfer the oscillation energy. Consequently, wear and tear is largely avoided in this manner. Furthermore, it is appropriate that the oscillation exciters operate at a frequency which is in the proximity of but not precisely the same as the resonant frequency of the elastically suspended jogging plates. Accordingly, the oscillation energy is effectively transferred to the jogging plate, without causing resonance increases which would otherwise jeopardize the operational reliability of the device.

The frequency of the oscillation exciter lies advantageously above 20 Hz, preferably between 50 and 100 Hz. Jogging frequencies of the aforementioned range obtain very good results with regard to the quality of the sheet pile which is delivered.

The oscillation exciter itself may be formed conventionally either of a solenoid or lifting magnet which is activatable against spring action or force and may be excitable periodically, of an oscillating magnet, of a pneumatic vibrator or possibly also of an oscillating mass which, for example, may be realized by a motor having a shaft to which an unbalanced mass is fastened.

By disposing the jogging plate within an adjustable sheet guide so that the jogging plate is incorporated or integrated into the sheet guide so as to be almost flush with the surface thereof results in the advantage that the jogging plate is always moved optimally towards the sheet edge.

Other features which are considered as characteristic for the invention are set forth in the appended claims.

Although the invention is illustrated and described herein as embodied in a device for forming a sheet pile in a delivery of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE INVENTION

DESCRIPTION OF THE PREFERRED EMBODIMENTS

Figure 1:
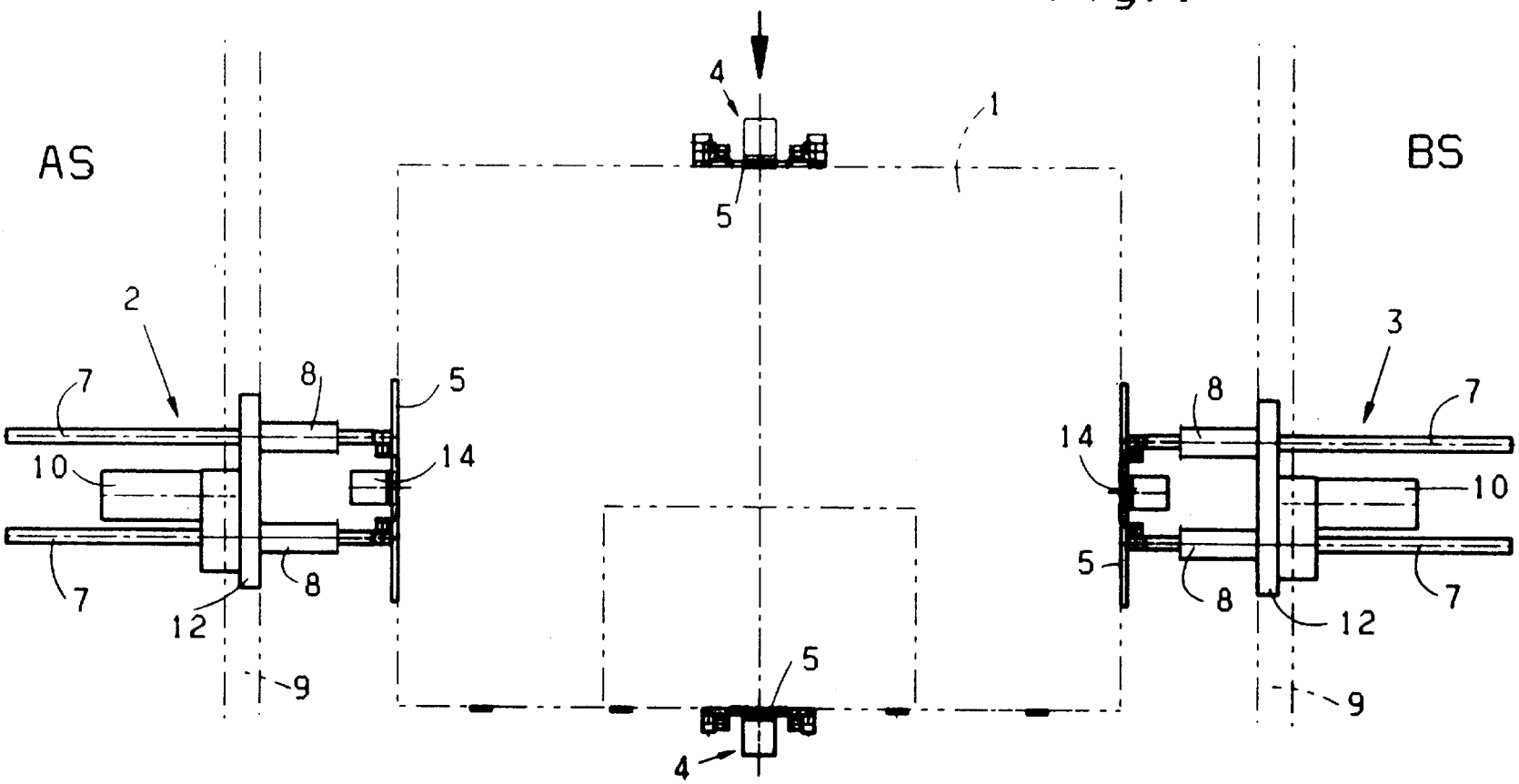
FIG. 1 is a top plan view of the device for forming a sheet pile according to the invention.

Referring now to the drawings and, first, particularly to FIG. 1 thereof, there is shown therein a device according to the invention for forming a sheet pile 1 in a delivery of a sheet-fed printing press, the device having jogging devices 2 and 3 provided on two sides of the sheet pile 1 generally referred to as the drive side AS and as the control or operating side BS, and jogging devices 4 provided on a front side of the sheet pile 1 and on a rear side thereof for jogging edges of the sheets forming the sheet pile 1. All four jogging devices 2, 3 and 4 are of identical construction and have a respective firmly mounted sheet guide 5 facing towards the sheets and limiting the sheet pile on the four sides thereof. The sheet guide 5 is adjustable to the respective sheet format or size manually or by motor at the drive side and at the control or operating side of the sheet pile 1. This is made possible by guide pins 7 which are fastened to the sheet guide 5 perpendicularly to the end face or front side of the sheet pile 1, and engage in guide bushings 8 wherein they are adjustable and lockable. The guide bushings 8 are disposed in a mounting plate 12 provided in a side wall 9 of the delivery, the mounting plate 12 itself being adjustable perpendicularly to the travel direction of the sheet pile 1, i.e., parallel to the lateral front edge of the pile 1, also either by a motor or manually.

Figure 2:
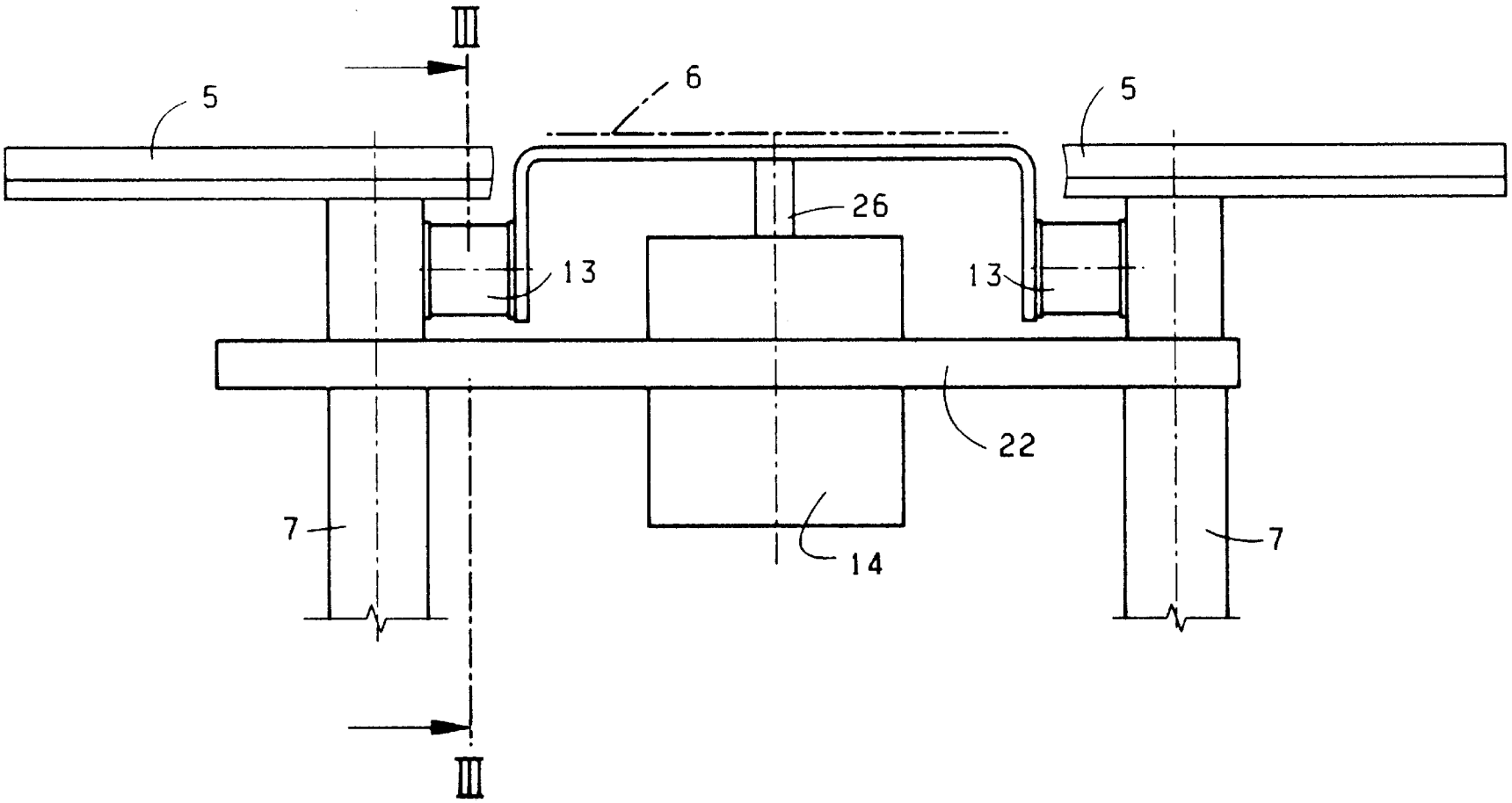
FIG. 2 is an enlarged fragmentary view of FIG. 1, showing in greater detail a jogging plate according to the invention and how it is suspended in a sheet guide.
Figure 3:
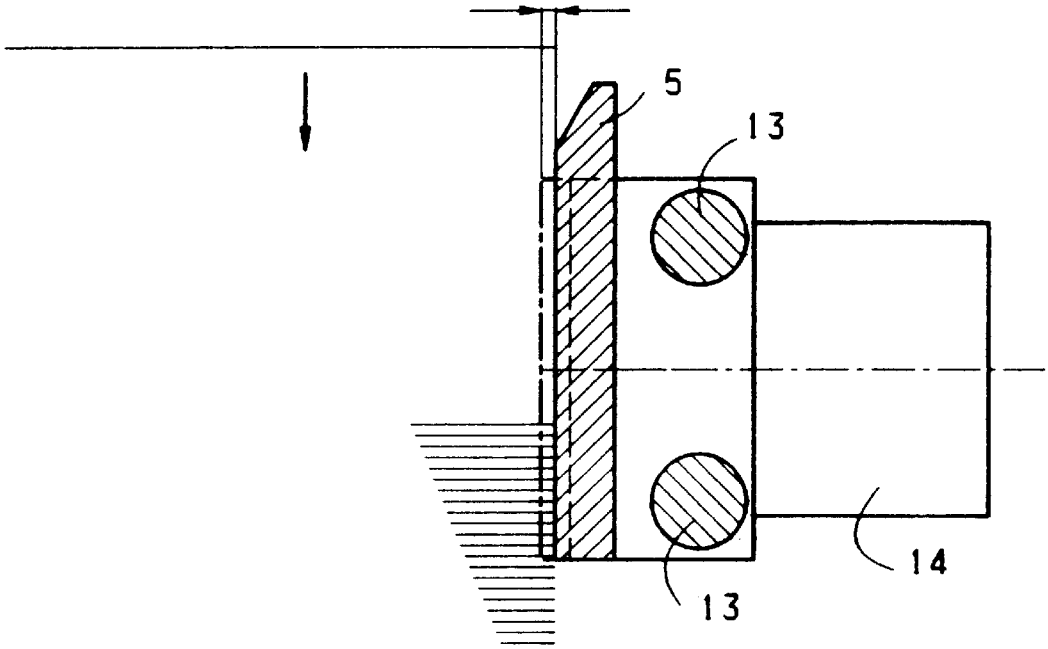
FIG. 3 is a cross-sectional view of FIG. 2 taken along the line III—III in the direction of the arrows and showing in further detail the sheet guide and how the jogging plate is suspended therein.
Figure 4:
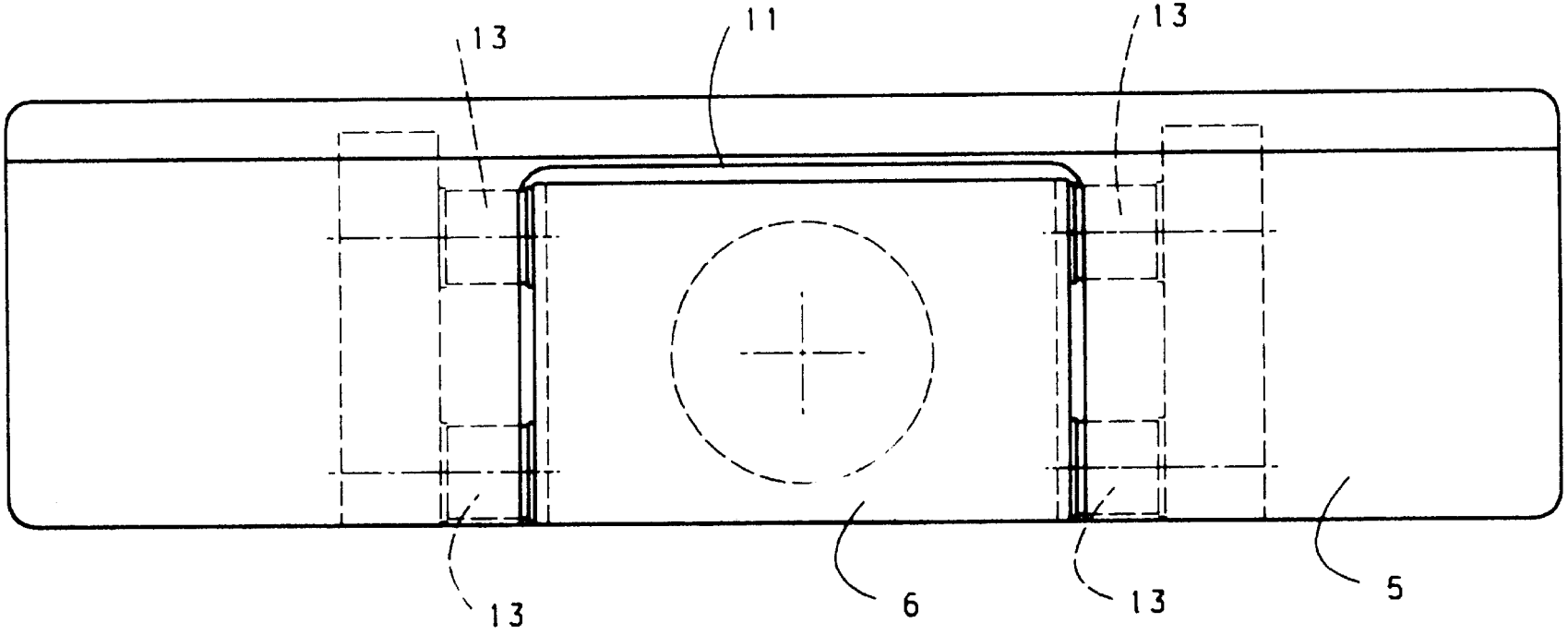
FIG. 4 is a front elevational view of the jogging plate of FIG. 3 as seen from the sheet pile.

The sheet guides 5 are formed with respective window-shaped cutouts 11 (FIG. 4). In each of the cutouts 11, a respective jogging plate 6 is suspended in a freely swinging manner so that the outer surface thereof facing towards the sheets is incorporated into the surface of the sheet guide 5 so as to be almost flush therewith, the jogging plate 6, during the oscillating movements thereof, consequently extending only slightly beyond the surface of the sheet guide 5, as indicated in phantom, i.e., by dot-dash lines, in FIG. 2. In the embodiment of the device according to the invention shown in FIG. 2, the freely swinging suspension of the jogging plate 6 is realized by four cylindrical bearings 13 made of an elastomeric material. Rubber pads may be used for this purpose, however, it is also conceivable to use springs, for example, or the like. Primarily, the bearings 13 are supposed to permit the jogging plate 6 to oscillate in a direction towards and away from the sheet pile 1.

Figure 5:
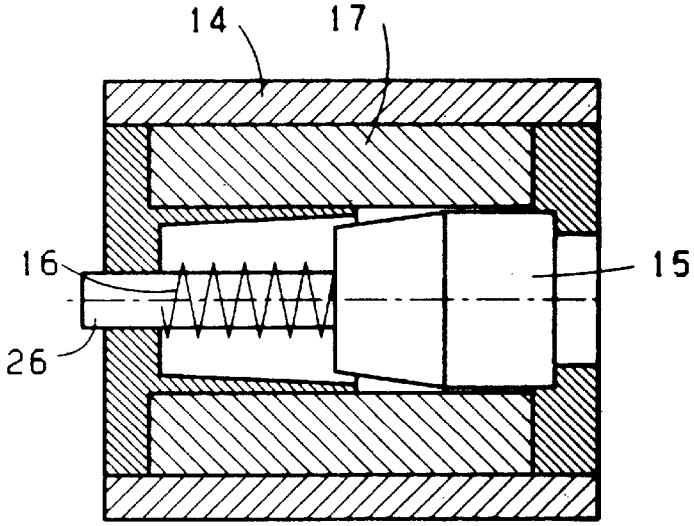
FIG. 5 is a fragmentary longitudinal sectional view of FIG. 2 showing an oscillation exciter formed as a lifting magnet and constituting part of the device according to the invention.

A solenoid or lifting magnet 14 periodically excited with a frequency of 25 Hz, for example, causes the jogging plate 6, with a plunger 26 of the solenoid magnet 14 connected to the jogging plate 6, to oscillate. FIG. 5 is a sectional view, taken in axial direction, of a solenoid or lifting magnet suitable for the foregoing purpose. In the view of FIG. 5, an armature 15 oscillates against the action of a spring 16 and is surrounded by an armature winding 17.

Figure 6:
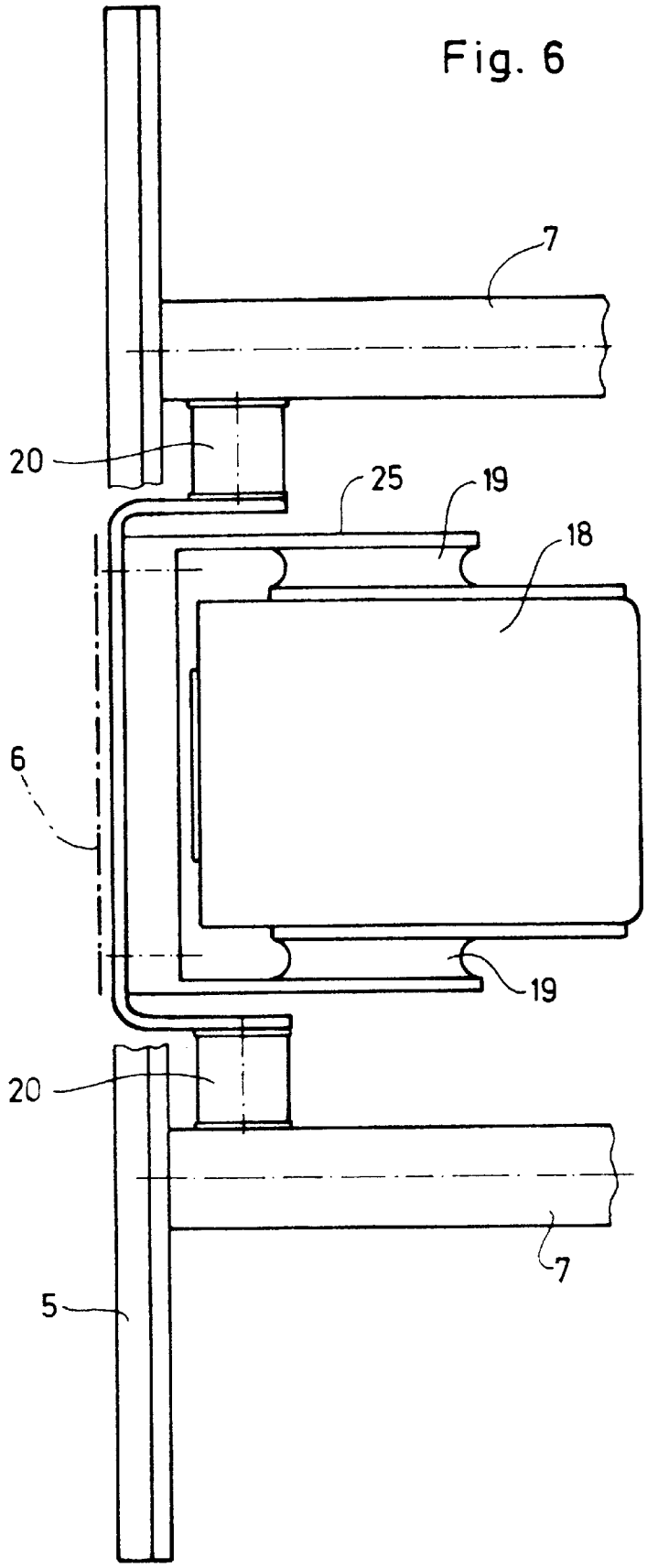
FIG. 6 is a top plan view like that of FIG. 2 of another embodiment of the device according to the invention having a different jogging plate and oscillation exciter.

Another oscillating drive for the jogging plate 6 is shown in FIG. 6 where, through the intermediary of elastic fastening elements 19, an oscillating magnet 18 is held in a bracket 25 which is directly connected to the jogging plate 6. The jogging plate 6, in turn, is elastically fastened to the mounting support of the sheet guide 5 by rubber pads 20. Because the jogging plate 6 is made of steel, it forms, together with the oscillating magnet 18, a counter-oscillating structure due to the periodic excitation of the oscillating magnet 18, the rubber pads 20 ensuring that the oscillations of the structure are largely decoupled from the stationary sheet guide 5.

Instead of an oscillating magnet 18, it is conceivable to use a motor with an unbalanced or eccentric mass causing the jogging plate 6 to oscillate.

Figure 7:
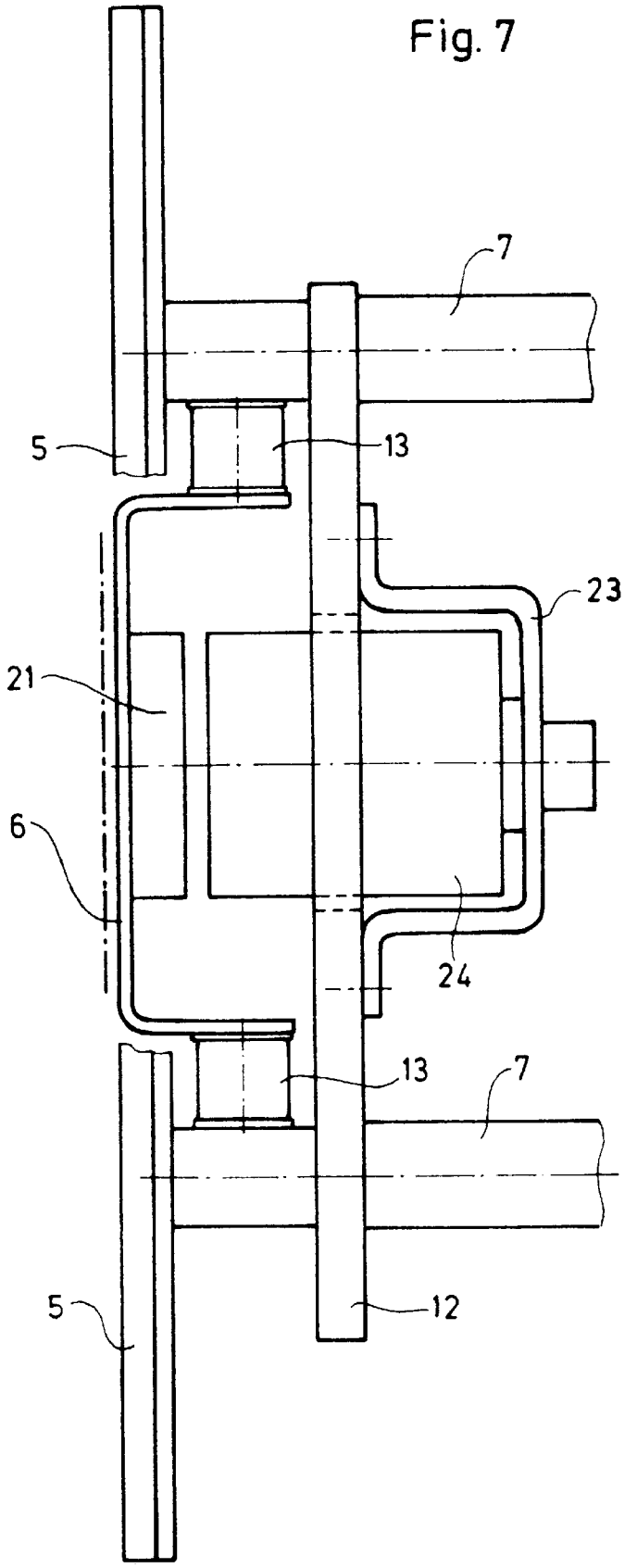
FIG. 7 is a top plan view like those of FIGS. 2 and 6 of a further embodiment of the device according to the invention having yet a different jogging plate and oscillation exciter.

In the embodiment according to FIG. 7, an electromagnet 24 is fastened to a plate 22 by a bracket 23, unlike the magnet 18 of FIG. 6, the mounting support of the plate 22, in turn, being connected to the stationary sheet guide 5.

The jogging plate 6 is likewise connected again to the mounting support of the sheet guide 5 via elastomeric cylindrical bearings 13. At the side of the jogging plate 6 facing towards the magnet 24, the jogging plate 6 carries a permanent magnet 21. When the electromagnet 24 is excited with an alternating current, the magnetic field transfers the oscillation energy to the permanent magnet 21 which thereby causes the jogging plate 6 to oscillate and vibrate, respectively. This type of contactless transfer of oscillation energy is particularly effective. Tests have shown that an electric power of approximately 20 watts is sufficient to oscillate the jogging plate 6 in order to achieve a high-quality sheet deposition. The excitation with an alternating current is effected with a frequency of 60 Hz, whereas the natural frequency of the elastically suspended jogging plate 6 lies somewhat lower for the purpose of executing oscillations perpendicularly to the front side of the sheet pile 1. Operating beyond the resonant frequency of the jogging plate 6 has proved to be advantageous.

In the described embodiment, the oscillation energy is transferred from the oscillation exciter to the jogging plate 6 entirely without contact. Therefore, virtually only the elastic cylindrical bearings 13, such as rubber pads, for example, are subjected to wear and tear. However, tests have proven that, during the service life of a delivery, the wear and tear remains so small that the rubber pads do not have to be replaced.

Instead of the permanent magnet 21, an iron plate may be used in the foregoing described embodiment, with a deduction of the effectiveness of the oscillation energy transfer.

Furthermore, it is conceivable to use piezoelectric oscillators or pneumatic oscillators, for example, instead of the electromagnetic oscillation exciters shown in the drawings. It is also possible to use oscillation exciters which operate like a plunger-type or moving coil system.

Via electrical control, the jogging plates may be operated on the various sides of the sheet pile 1, either individually, groupwise, or all together simultaneously.

We claim:

1. A device for forming a sheet pile in a delivery of a sheet-fed printing press, the device comprising:

jogging plates for jogging edges of a sheet, said jogging plates being disposed perpendicularly to a lateral surface of the sheet pile and being drivable so as to move in a sheet guide provided for at least one of guiding and stopping the sheet, said jogging plates being directly elastically suspended from said sheet guide; and an oscillation exciter connected to each of said jogging plates for respectively oscillating and vibrating said jogging plates independently of a cycle of the delivery, each of said jogging plates connected magnetically to said oscillation exciter in a contactless manner for transferring oscillation energy.

2. The device according to claim 1, wherein said sheet guide is adjustable.

3. The device according to claim 1, wherein said oscillation exciters are connected to said jogging plates so almost only oscillation energy is transferable.

4. The device according to claim 1, wherein said oscillation exciter is operative at a frequency which is proximal to the resonant frequency of said elastically suspended jogging plates.

5. The device according to claim 4, wherein the frequency of said oscillation exciter is greater than 20 Hz.

6. The device according to claim 5, wherein the frequency of said oscillation exciter is within the range of 50 to 100 Hz.

7. The device according to claim 1, wherein said oscillation exciter has a solenoid magnet activatable against spring action, said solenoid magnet being periodically excitable.

8. A device for forming a sheet pile in a delivery of a sheet-fed printing press, the device comprising:

jogging plates each having an active surface for jogging edges of a sheet, said jogging plates being disposed perpendicularly to a lateral surface of the sheet pile and being drivable so as to move in a sheet guide provided for at least one of guiding and stopping the sheet, said jogging plates being directly elastically suspended from said sheet guide;

said guide sheet having a surface and formed with a cutout therein, a respective jogging plate disposed in said cutout formed in said sheet guide, and said active surface of each of said jogging plates incorporated into and almost flush with said surface of said sheet guide; and an oscillation exciter connected to each of said jogging plates for respectively oscillating and vibrating said jogging plates independently of a cycle of the delivery.

9. A device for forming a sheet pile in a delivery of a sheet-fed printing press, the device comprising:

jogging plates for jogging edges of a sheet, said jogging plates being disposed perpendicularly to a lateral surface of the sheet pile and being drivable so as to move in a sheet guide provided for at least one of guiding and stopping the sheet, said jogging plates being directly elastically suspended from said sheet guide; and an oscillation exciter connected to each of said jogging plates for respectively oscillating and vibrating said jogging plates independently of a cycle of the delivery, said oscillation exciter is an oscillation magnet elastically fastened to a respective jogging plate.

10. A device for forming a sheet pile in a delivery of a sheet-fed printing press, the device comprising:

jogging plates for jogging edges of a sheet, said jogging plates being disposed perpendicularly to a lateral surface of the sheet pile and being drivable so as to move in a sheet guide provided for at least one of guiding and stopping the sheet, said jogging plates being directly elastically suspended from said sheet guide;

an oscillation exciter connected to each of said jogging plates for respectively oscillating and vibrating said jogging plates independently of a cycle of the delivery, said oscillation exciter is an electromagnet connected to one of said sheet guide and a mounting support therefor; and at least one component of a group thereof consisting of an iron part component and a permanent magnet component located at a respective jogging plate, said electromagnet having a field acting upon said at least one component.

* * * * *